United States Patent [19]

Moore

[11] Patent Number: 4,739,913

[45] Date of Patent: Apr. 26, 1988

[54] BACKPACK TYPE CARRIER FOR PORTABLE OXYGEN DISPENSERS

[75] Inventor: Ann A. Moore, Evergreen, Colo.

[73] Assignees: Michael C. Moore; Leslie G. Beauparlant, both of Evergreen, Colo. ; a part interest

[21] Appl. No.: 855,477

[22] Filed: Apr. 24, 1986

[51] Int. Cl.[4] ..... A45F 3/04

[52] U.S. Cl. ..... 224/215; 224/214; 128/205.22; 383/106

[58] Field of Search ..... 224/211, 209, 210, 213, 224/214, 215, 259, 260, 261, 262; 383/106; 128/205.22, 202.18

[56] References Cited

U.S. PATENT DOCUMENTS

| | | | |
|---|---|---|---|
| 3,957,184 | 5/1976 | Shurman | 224/211 |
| 4,267,960 | 5/1981 | Lind et al. | 383/106 |
| 4,356,942 | 11/1982 | Hayes | 224/211 |
| 4,579,264 | 4/1986 | Napolitano | 224/160 |

*Primary Examiner*—Henry J. Recla
*Assistant Examiner*—David Voorhees
*Attorney, Agent, or Firm*—Edwin L. Spangler, Jr.

[57] ABSTRACT

This invention relates to a backpack type carrier for portable oxygen dispensers characterized by a padded frame, shoulder straps and a hip-encircling belt for supporting the frame on the back of the wearer, a flap formed of breathable material having a lower marginal edge attached to the padded frame in the area of the belt and extending upwardly therefrom so as to cooperate with the frame to define an open-topped pouch for the reception of a portable self-contained oxygen dispenser, retaining members connecting portions adjacent the sides of the flap to the frame for confining the sides of the oxygen dispenser while simultaneously permitting by-products exhausted from the latter to escape into the atmosphere, and a pocket on the outside of the flap for storing the oxygen delivery tube and associated nosepiece when not in use.

12 Claims, 3 Drawing Sheets

BACKPACK TYPE CARRIER FOR PORTABLE OXYGEN DISPENSERS

More and more people suffering from respiratory diseases and the like who, until recently, were confined to a limited locale determined by the availability of a non-portable source of oxygen have now had their ability to move around greatly enhanced through the use of portable oxygen dispensers of one type or another. Such dispensers generally come in one or two forms, the first being the conventional oxygen bottle and the second, the lighter weight specially-designed cannisters of various shapes and sizes. Both types constitute pressure vessels capable of carrying oxygen in a liquid form and metering it out to the user in gaseous form. As such, they are not oxygen generators but merely portable containers and dispensers thereof.

One significant attribute of the specially-designed cannister-type dispensers is the fact that they are equipped with a shoulder strap by means of which the user can carry it over his or her shoulder. Most of these same units also are designed to be pulled along on a two-wheeled cart of the general type used to haul luggage. Both the cart-mounted and over-the-shoulder versions of both of these dispensers have a significant drawback, however, and that is that the user is, for all practical purposes, denied the use of both his or her hands and arms; yet, many persons suffering from respiratory deficiencies are not so incapacitated that they cannot hike, walk along a trout stream casting a fly, perhaps play a leisurely round of golf, engage in hobbies such as gardening or do other things where being able to move around and use both hands is a decided convenience, if not absolutely essential.

The prior art is, of course, replete with various and sundry backpack type carriers for transporting on one's back everything from small children to camping gear. Applicant, herself, is the inventor of a backpack type carrier for infants and small children, namely, U.S. Pat. No. 4,434,920, while her mother was the inventor of an earlier version forming the subject matter of U.S. Pat. No. 3,481,517. Representative of other such patents are the following U.S. ones:

| | |
|---|---|
| 33,343 | 3,127,077 |
| 3,158,299 | 3,347,429 |
| 4,438,763 | 4,561,578 |

Some of the aforementioned patents have rigid frames while others employ soft frameless constructions. All of them have over-the-shoulder straps and most have waist-encircling belts. In the back, supported by the frame or frameless substitute for the latter, is usually found one sort of container or another for the goods to be carried. Some of these containers are soft and made of fabric while others are rigid box-like units. With but minor changes, certain of these units could, obviously, be adapted to house and carry an oxygen dispenser.

Others before applicant recognized this possibility and, as a result, developed backpack type carriers specifically adapted to carry oxygen bottles, mostly for use by scuba divers. Representative of several U.S patents for this purpose are those listed below:

| | |
|---|---|
| 3,106,323 | 3,219,242 |
| 3,774,825 | 4,383,528 |
| 4,449,655 | |

The above-mentioned Eppolito U.S. Pat. No. 4,383,528 is, insofar as applicant is aware, the only one dealing with the problem of supplying oxygen from a portable source thereof to a person suffering from a respiratory deficiency and even it ignores the everyday needs of the patient and concentrates instead upon the use of such equipment by emergency medical personnel.

Applicant has discovered, however, that the prior art backpack type carriers of the type mentioned above have various deficiencies which render them unsuitable for use with modern-day portable oxygen dispensers which are vented. In other words, those which include a receptacle which is closed at the bottom, front, back and along both sides cannot be used safely with a vented dispenser because provision must be made for exhausting to the atmosphere what little oxygen is not delivered directly to the user through the delivery tube but which escapes through the vents. Oxygen, of course, is highly flammable and, for this reason, constitutes a safety hazard of no small consequence.

The backpacks developed to carry the tanks of a scuba diver require little or no padding between the tanks and the user's back for the simple reason that the buoyancy of the water minimizes whatever discomfort, if any, that the wearer might experience if he or she were called upon to carry the tanks for any protracted period on land. Moreover, either the padding would have to be sealed in a waterproof jacket or, alternatively, a type used which would not soak up water, otherwise, the additional weight would be prohibitive. Also, using a rigid unpadded frame like those shown in several of the prior art patents identified above is not the answer, especially when most of the people who need to use supplementary oxygen in the first place are in poor, or at least delicate, health and any further discomfort just adds to their already difficult physical burden. By the same token, a frameless pack is not the answer either in that such units permit the relatively heavy bottle or other dispenser to shift from side-to-side and bang against the back even under conditions of a reasonably low level of physical activity. If, as is all too often the case, the patient is elderly and frail to start with, any shift in weight which might cause them to lose their balance and fall must be avoided at all cost.

Also, the design of most backpacks is such that the load is carried primarily on one's shoulders and upper body. A patient suffering from respiratory problems, on the other hand, must, if at all possible, leave his or her upper body free of any significant restraint since such people develop accessory misculature that aid them in breathing and these muscles, if at all possible, remain uninhibited.

While many of the prior art backpacks have pockets, both large and small, it is, nevertheless, important that an oxygen dispenser carrier of the type forming the subject matter hereof have one for the storage of the oxygen delivery hose and mouthpiece or nosepiece when not in actual use. These items must be protected from abuse and damage because if they are broken, have a hole in them or are otherwise incapable of delivering the oxygen to the patient's nose or mouth, the consequences can be serious. It is important to remember that someone fighting for breath in the case of a malfunction is, more than likely, probably not the best person to rely upon to correct even the most minor deficiency in the breathing apparatus even though to do so may mean the difference between proceeding in comfort or having to terminate a particular activity. Along this same line, even while in use, provision should be made for insuring that the delivery tube is protected against kinking, abrasion and the like. While prior art units like that shown in the previously-mentioned Faro U.S. Pat. No. 3,127,077 include provision for guiding a tube from the back over the shoulder, such eyeleted metal brackets, even though they appear to be grommeted, are likely to be more abrasive than one would desire in a thin-walled oxygen delivery tube.

Not infrequently, people with respiratory problems are trained in the technique of so-called "abdominal breathing". When this is the case, the customary waist-encircling belt of the prior art backpacks becomes unsatisfactory in that it can severely inhibit this practice, especially if cinched up tight; therefore, this is but yet another aspect in the design of a proper backpack for a portable oxygen dispenser that must be gived due consideration.

Oxygen bottles present particular problems although, not being vented, they eliminate some of the considerations that must be taken into account with the more up-to-date cannister-type dispensers. To begin with they are heavier and thinner which means that a pouch effective to confine and effectively hold a cannister-type unit may not work at all well for the bottle and vice versa; yet, the preferred design would be one adapted to accommodate both. Also, bottled oxygen seems to be the most common medium for use with infants suffering from respiratory problems; however, due to the delicate nature of the patient and their small lung capacity, these bottles must be fitted with pressure regulators and other accessories that are an integral part of the cannister-type units used by an adult. When these regulators are used, regardless of the type of dispenser to which they are fitted, they stick up into the area directly behind the user's neck and, therefore, become a potential source of injury whenever the head is laid back or, perhaps, even jerked back due to a whiplash-type injury that so often occurs in an auto accident. Not only, therefore, should the head be protected against injury but, in addition, provision must be made for reading the gages and adjusting the pressure and flow should it become necessary to do so. It should, perhaps, be pointed out that when used as a carrier for a source of oxygen to be used by an infant too small to carry the backpack by himself or herself, it would be carried on the back of an adult who would, in turn, carry the child connected to the source in the usual manner.

An incidental, but nonetheless handy, appurtenance is a simple carrying handle which is a great help in assisting the user to get the unit on and off his or her back especially if the patient is weak or infirm or both. In the case of a child old enough to walk but too small to carry the backpack, an adult can carry it by the handle while delivering oxygen to the young person through the delivery tube. Also, a handle aids in lifting the assembly in and out of the car or hanging it up someplace like, for example, on the back of a chair or even in a closet when not in use.

Applicant has discovered in accordance with the teaching of the present invention that a backpack type carrier for portable oxygen dispensers can, in fact, be made which is comfortable, frees the hands and both arms of the user to perform other tasks, allows vented cannister-type units to breathe, safely and securely holds both the cannister-type and conventional oxygen bottle dispensers, is safe in that it provides protection for the oxygen delivery tube against kinking and chafing, and can be padded to protect the user's head from coming into contact with a regulator subassembly positioned atop thereof while leaving the gages fully visible. In addition, the carrier does not interfere with those patients who must practice abdominal breathing and it is especially well suited for use by persons with respiratory problems who have developed supplemental upper body musculature in that the load is carried primarily by the hips and not over the shoulders and across the chest. Last, but by no means least, the carrier enables an adult to carry a source of oxygen required by an infant while freeing both hands to carry the child.

It is, therefore, the principal object of the present invention to provide a novel and improved backpack type carrier for portable oxygen dispensers.

A second objective is the provision of a device of the type aforementioned which frees both hands and arms of the wearer and is so constructed that it will not interfere with abdominal breathing.

Another object of the invention herein disclosed and claimed is to provide a more or less universal carrier equally adapted to carry the oxygen bottle as well as the cannister-type dispensers safely and securely.

Still another objective is that of providing a backpack type carrier especially adapted for use with vented oxygen cannisters because the pouch housing the latter is formed of a porous breathable material.

An additional object is the provision of a padded, yet substantially rigid, frame for the carrier which effectively isolates the oxygen container from rubbing or pressing against the back of the wearer and which can even be fitted with a padded cap covering the hardware on top thus preventing the head from coming into direct contact therewith.

Further objects are to provide an oxygen dispenser carrier to be worn on the back which is comfortable, lightweight, versatile, safe, compact and readily adaptable to different types and configurations of oxygen dispensers as well as sizes and shapes of users while, at the same time, remaining decorative in appearance.

Other objects will be in part apparent and in part pointed out specifically hereinafter in connection with the description of the drawings that follows, and in which.

Figures 1, 2:
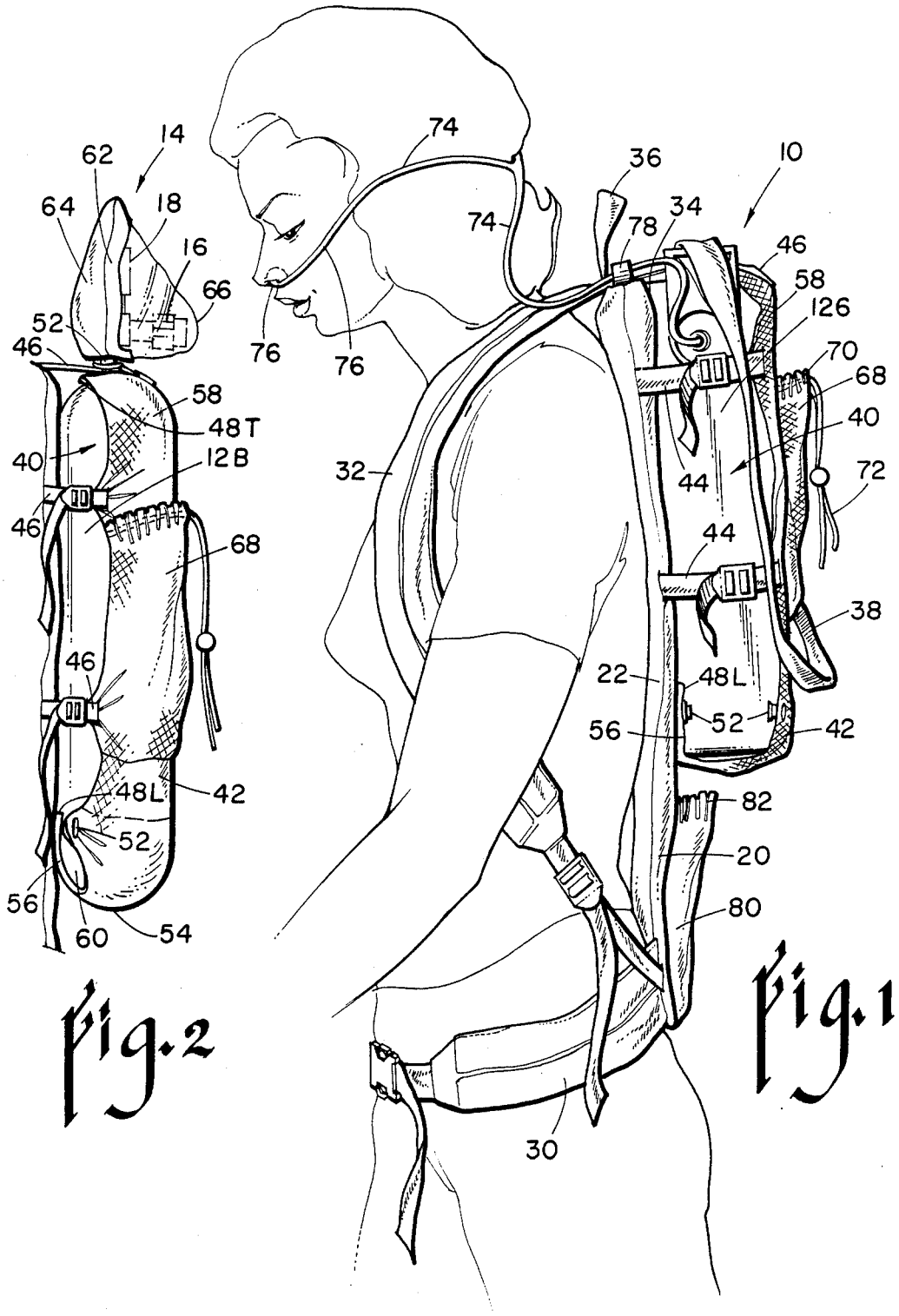
FIG. 1 is a side view showing the backpack type carrier of the present invention containing a cannister-type oxygen dispenser strapped to the back of an adult wearer.
FIG. 2 is a fragmentary detail to the same scale as FIG. 1 showing a side view of the same carrier cinched up with adjustable straps alongside thereof to hold a longer, narrower and fatter conventional oxygen bottle having a regulator subassembly atop thereof, the latter being shown covered by a padded head protector having a viewing window therein.
Figure 7:
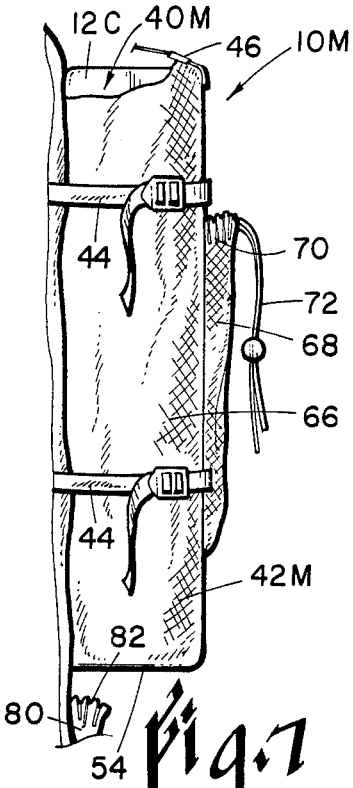
Figure 6:
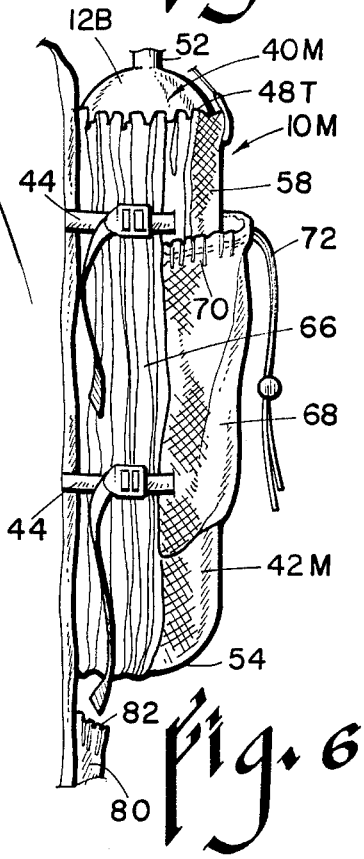

FIG. 6 is a fragmentary side elevation similar to FIG. 2 and to the same scale but showing a slightly different version of the breathable pouch having integrally-formed side panels attached to the padded frame; and, FIG. 7 is a fragmentary side elevation like FIG. 6 showing the same version of the pouch to the same scale as FIGS. 2 and 6 but housing a cannister-type dispenser as opposed to the conventional oxygen bottle shown in previous FIG. 6.

Referring next to the drawings for a detailed description of the present invention and, initially, to FIGS. 1, 3, 4 and 5 for this purpose, reference numeral 10 has been selected to broadly designate the backpack type carrier in its entirety while numeral 12 refers to the oxygen dispenser carried therein. FIGS. 1, 3, 5 and 7 show the carrier fitted with what has been referred to previously as a "cannister-type" carrier while FIGS. 2 and 6 show the oxygen bottle type. The dispenser cannot, of course, be seen at all in FIG. 4. For purposes of differentiating between the two basically different types of dispensers, the cannister-type will be given reference numeral 12C while the bottle will be referred to using 12B. It is to be understood, of course, that no claim is made with respect to either type of dispenser since both are old and well known in the art. They do, however, each present somewhat different problems that have to be effectively addressed and solved by the carrier. For instance, the cannister-type unit is, generally speaking, a good deal lighter, thinner, shorter and more compact than the bottle although it is over twice as wide. More important, however, is the fact that the cannister-type dispensers are vented, sometimes on the sides and in others at the back, while the bottles are not. Also, at the present time at least, most of the bottles are fitted with regulator subassemblies that have been indicated in FIG. 2 in a general way by reference numeral 14 and which include a flow control valve 16, a gage 18 calibrated to show the quantity of oxygen being delivered to the patient in a given time interval and a second gage (not shown) that tells what size of orifice is being used. Cannister-type units, on the other hand, are not fitted with regulator subassemblies 14. Whether the dispenser has such a regulator subassembly atop thereof is only significant as far as the present invention is concerned because it presents a potentially hazardous group of elements projecting into a position directly behind the head of the wearer which, conceivably, could be a source of injury. In the shorter cannister-type units that have no such projecting hardware, there is no such problem that should be dealt with.

Figure 3:
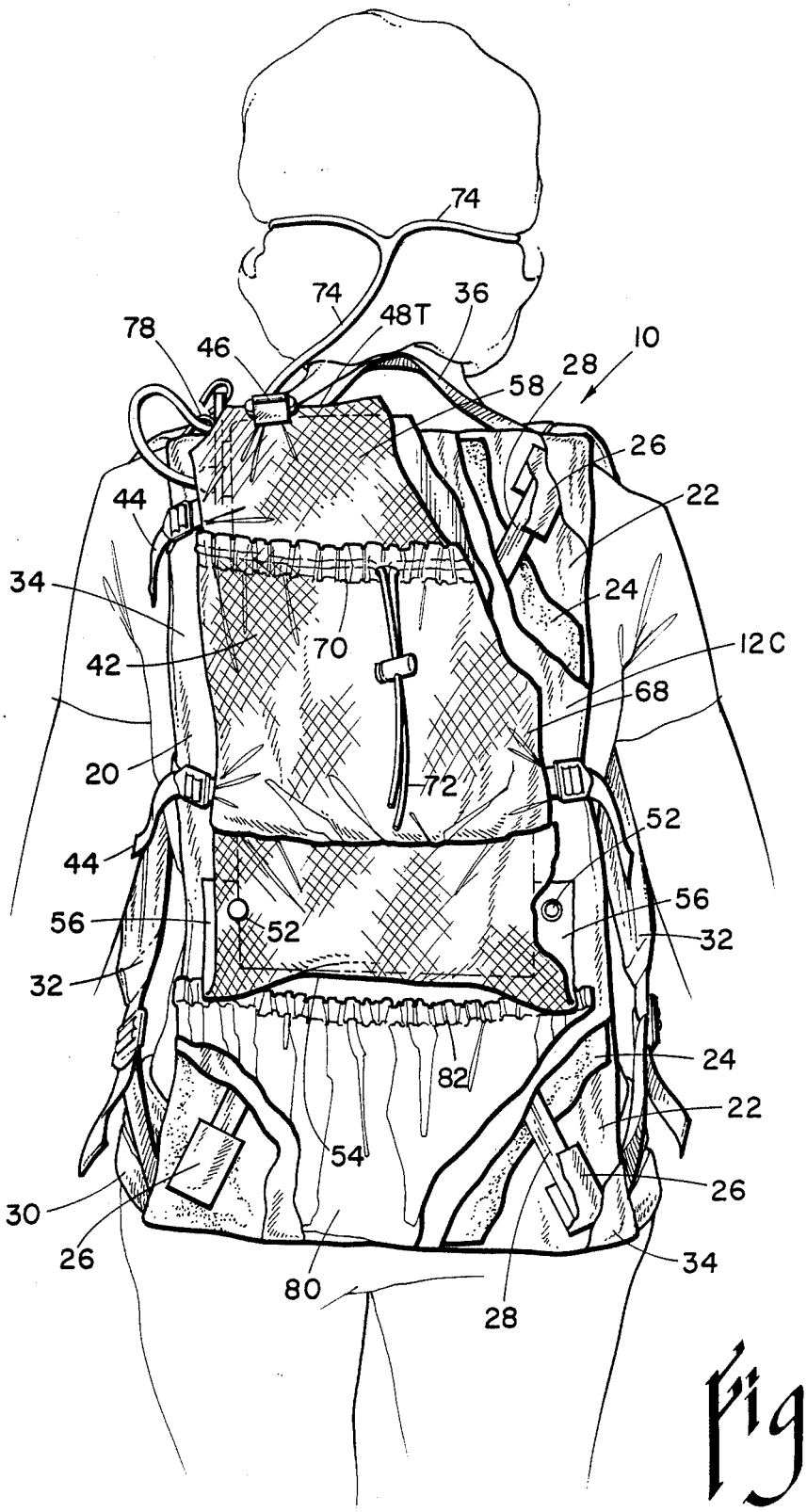
FIG. 3 is a rear elevation of the carrier and wearer thereof of FIG. 1, again to the same scale as the latter, but also showing portions broken away to reveal the padded frame.
Figure 4:
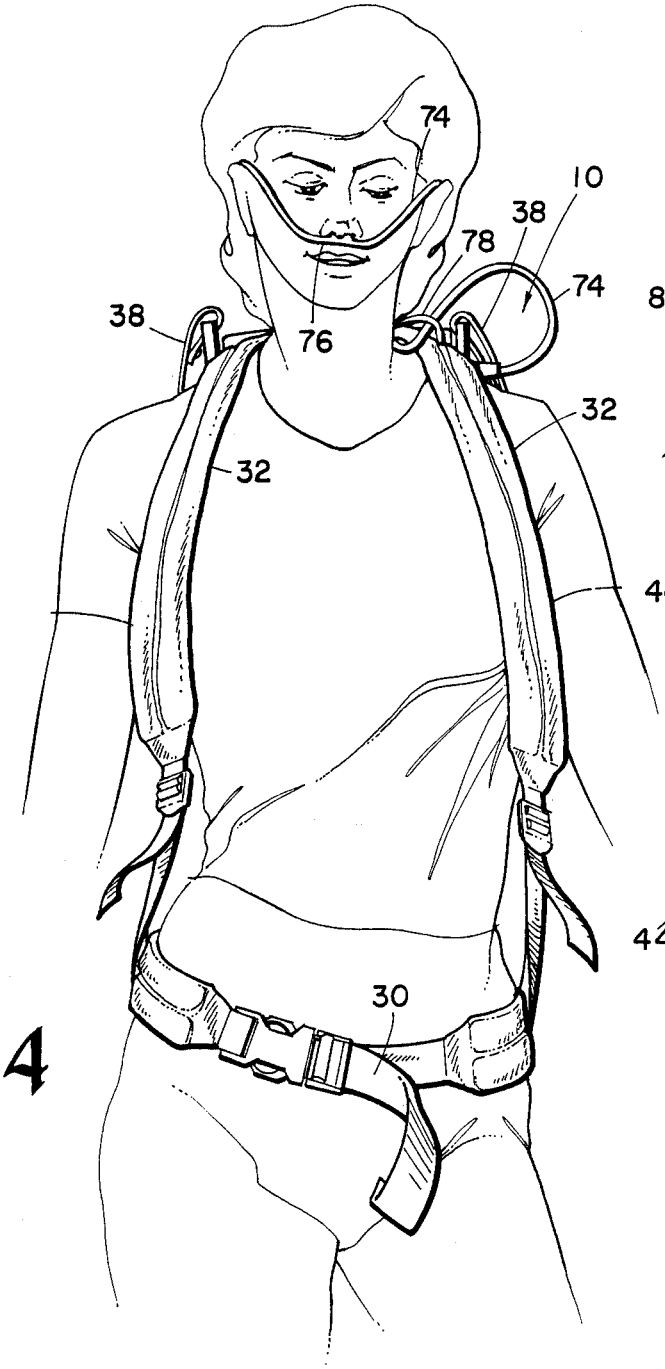
FIG. 4 is a front elevation of what is shown in FIGS. 1 and 3 but to a slightly reduced scale.

Returning to FIGS. 1, 2, 3 and 5, it can be seen that the carrier 10 includes a padded frame 20 which, as seen most clearly in FIG. 4, has a fabric face 22 backed up with a cushion-forming insert 24 made of a foamed polyurethane, rubber or some other such soft resilient material. Pockets 26 are sewn or otherwise attached in the four corners of the frame 20 in position to receive and retain the ends of crossed rigid frame-forming struts 28. Two such struts arranged in X-shaped relation are used in the particular embodiment shown in FIG. 3. In the preferred construction seen in FIG. 1, it will also be apparent that the padded frame is preferably contoured slightly so as to better fit the back and this is accomplished, obviously, by slightly bending the struts of the frame.

The pad is slightly tapered from bottom to top and extends generally from the base of the neck to, preferably, well down onto the wearer's hips even though the cannister-type dispenser rides well above the waist as can be seen in FIG. 1. The reason for this is two-fold. First of all, the hips provide better support for the load carried than does the waist. More significant for present purposes, however, is the fact that by extending the pad 20 well down onto the hips, the body-encircling strap 30 goes around the hips rather than the waist and, as a result, provides no restriction to expansion of the abdominal muscles used in abdominal breathing. Strap 30 is, otherwise, conventional as are the shoulder straps 32 which, in the particular form shown, are heavily padded, adjustable and extend from the upper outside corners 34 of the padded frame down to their points of attachment at the lower outside corners 36 thereof without crossing in front of the body, i.e. from right upper righthand corner to lower righthand corner, etc. This style and arrangement of shoulder straps is, likewise, conventional.

Covering the struts and cushion and sewn to the front panel 22 of the padded frame is a rear fabric panel 34, these two panels cooperating to define an envelope for the elements housed therein. Attached in centered position between the upper corners of the padded frame is a carrying handle 36 in the form of a short strap. Note in FIGS. 1, 4 and 5, a considerably longer strap 38. This strap has nothing to do with the carrier 10 but, instead, is merely the shoulder strap attached to the cannister-type oxygen dispenser.

One of the most significant features of the present invention is the pouch indicated in a general way by reference numeral 40 formed by the porous breathable fabric panel 42, its associated straps 44 and 46, and the padded frame. Panel 42 has it lower marginal edge 48L (see FIG. 1) turned up and under the remainder thereof where it is sewn or otherwise fastened to the back of the padded frame at a level intermediate the top and bottom edges of the latter and below the top a distance such that when it is passed down and across underneath a typical cannister-type oxygen dispenser like that illustrated, it will reach approximately to the top of the latter when laid up along its back. When thus dimensioned, the same panel 42 will cover most, if not quite all, of the slightly longer oxygen bottle in the manner illustrated in FIG. 2 which will be described presently.

Figure 5:
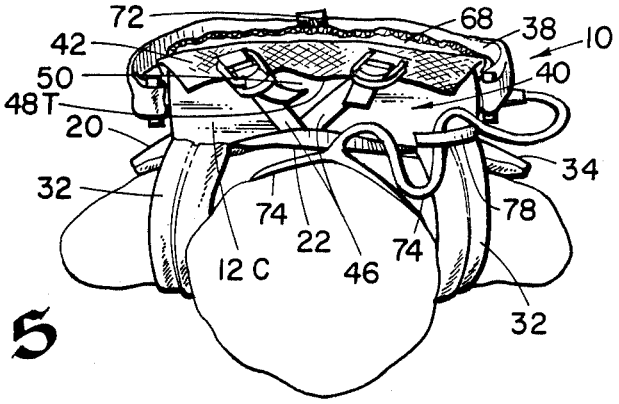
FIG. 5 is a top plan view of this same assembly but to the scale of FIG. 4.

Straps 46 are most clearly revealed in FIG. 5 where they will be seen to converge at the top center of the padded frame from transversely-spaced points of attachment on the top margin 48T of panel 42. The triangular space 50 formed between panel 42 and these converging straps 46 essentially bracket the neck 52 of the oxygen bottle 12B thereby keeping at least the top thereof from shifting from side-to-side. The manner in which the bottom and sides thereof are confined and restrained is somewhat different as will become apparent in connection with FIG. 2 soon to be described. Straps 46, in the case of the cannister-type oxygen dispenser of FIGS. 1 through 4, on the other hand, merely hold the cannister securely in the pouch and keep it from coming out through its open top. In a similar manner, side straps 44 attached at vertically-spaced points along both side margins of the padded frame and panel 42, do likewise in confining and retaining the sides of the cannister while, at the same time, leaving the sides thereof open to the atmosphere. In some versions of the cannister-type oxygen dispensers, vents (not shown) are provided in one side or the other or both of the cannister for the purpose of venting excess oxygen. In still others, the vents are in the back. Either place, it is imperative from a safety standpoint that this highly flammable gas be allowed to escape freely into the atmosphere where it quickly dilutes to a point where it will no longer support combustion. A single strap on each side can, of course, replace the pair shown, however, to do so provides less protection against the possibility that the cannister might slip out of one of the open sides of the pouch. Snugging up straps 44 and 46 holds the cannister securely in place while, at the same time, insuring that it can "breathe" in the sense of being able to exhaust any excess oxygen safely. The porous breathable fabric, preferably coarse netting, out of which the panel 42 is made, insures that even rear-vented cannisters are no reason for concern.

Directing attention briefly to FIGS. 1, 2 and 3, and particularly FIG. 2, it can be seen that a snap fastener set 52 is located on opposite sides of the panel 42 spaced up from the portion 54 thereof which supports the bottom of both the cannister-type dispenser 12C and the bottle 12B. Upturned flap 56 at the front of pouch 40 cooperates with rear panel 58, the aforementioned bottom-supporting portion 54 and the snap fastener sets 52 when fastened together to define an upwardly-opening inside pocket 60 that is closed at both sides as seen most clearly in FIG. 2 and into which sits the rounded bottom of the oxygen bottle. Snap sets 52 effectively narrow the width of the pocket 60 to accommodate the considerably narrower oxygen bottle while, at the same time, side straps 44 are cinched up much tighter to draw portion 58 of the pouch-forming panel 42 around the sides thereof. Thus, by fastening the snaps and shortening straps 44, a much narrower and even slightly deeper pouch is formed which is sized and shaped to specifically accommodate an oxygen bottle and keep it from moving from side-to-side as well as up or down. The side straps 44 are loosened and the snaps left open as seen in FIG. 1 when a cannister is use.

Note also in FIG. 2 that the oxygen bottle 12B is equipped with a regulator subassembly 14 sitting atop thereof where the wearer's head could easily strike same if tilted rearwardly. Provision is shown for covering the regulator with a detachable hood 62 open at the bottom and having a padded front end 64 behind which is placed a transparent window 66 that allows the gages to be read. Raising the hood, of course, provides access to the control valve 16. Also, while the hood is shown attached to an oxygen bottle 12C, it could also be used on a cannister 12B fitted with a regulator.

Before returning to FIGS. 1, 3, 4 and 5 for a description of other features of the carrier 10, it might be well to examine briefly the modified pouch 40M of FIGS. 6 and 7 used on version 10M of the carrier illustrated therein. Pouch 40M is closed on the sides by making the porous breathable panel 42M considerably wider so that it can include side panels 66 that are attached to the padded frame 20 adjacent its side margins. The pouch 42M which results is sized to envelop the sides, back, front and bottom of a cannister-type oxygen dispenser 12C as shown in FIG. 7 leaving only the top open. Straps 44 attach to the panel 42M at points spaced rearwardly of its side margins attached to the padded panel as seen in both FIGS. 6 and 7. In the case of the cannister 12C, these straps are extended a good bit; whereas, when the pouch houses a bottle 12B as in FIG. 6, the straps 44 are shortened considerably thereby gathering the material forming the side panels 66 and pulling it in close against the sides of the dispenser. In this modified version of the carrier, no snap fasteners are required as in the previously-described version since the sides of the pouch are enclosed; nevertheless, snap fastener sets 52 can be used if desired to better confine the lower end of the bottle. If relatively wide-open netting is used for the pouch, the fact that the sides are closed in is of little significance since it can still breathe to the degree required to safely discharge to the atmosphere and oxygen exhausted from the cannister.

Each figure of the drawings reveals a pocket 68 attached to the back of the pouch 40 located in the particular form shown about midway between its top and bottom edges although, obviously, its location is not critical but rather a matter of choice. The top edge of the pocket is shown as including a hem 70 and a conventional drawstring 72. While this pocket may be used for storage of anything one wishes to place in it, the primary purpose it serves is that of a safe and secure place in which to put the oxygen delivery tube 74 and nosepiece 76 when not in use. As noted previously, it is imperative that these elements be protected against kinking, abrasion and any other kind of damage that could inhibit their ability to deliver oxygen to the patient. In furtherance of this same objective, the top edge of the padded frame 20 is provided with an openable fabric flap 78 which when closed cooperates therewith to define a loop for guiding and confining the oxygen delivery tube as it passes along the user's neck and up behind the head where it branches and goes both ways around the latter and over the ears where it attaches to the nosepiece. Any suitable fastener (not shown) can be used to detachably fasten the free end of the flap 78 down such as, for example, a Velcro strip, a snap fastener set, etc., provided only that it loosely receives the delivery tube and prevents it from being pinched or kinked.

Finally, FIGS. 1, 2, 3, 6 and 7, reveal yet another storage pocket 80 located at the bottom of the padded frame 20 on the portion thereof projecting beneath the lower extremity of the pouch. Its construction, in the particular form illustrated, is similar in most respects to the pocket 68 behind the pouch except that it has been shown as having an elastic cuff 82 along its top edge instead of a drawstring. Also, this pocket need not be made of a porous breathable material like pocket 68, but instead, can be constructed out of the same fabric used to make the panels covering the cushion and X-shaped struts of the padded frame. Pocket 80 is merely a utility pocket having little to do with the functional aspects of the backpack insofar as a carrier for portable oxygen generators is concerned; nevertheless, it is a handy "add-on" to the otherwise highly specialized pack.

What is claimed is:

1. The backpack type carrier for portable oxygen dispensers of the type having an oxygen container and an oxygen delivery tube connected to receive oxygen from said container and deliver same to a user, which comprises: a frame having a top, bottom and sides and being sized lengthwise to extend from adjacent to the base of the wearer's neck to have the bottom thereof located adjacent to the wearer's hip and buttock area below the wearer's waist, said frame being rectangularly shaped and sized to cover substantially all of a wearer's back area between the wearer's shoulder and hips; a body-encircling belt attached to the frame at the bottom edge of said frame to extend around the wearer's hips below the wearer's waistline whereby said body-encircling belt is located spaced away from the wearer's chest and abdominal region and can be tightly cinched about the wearer without substantially interfering with the breathing of the wearer; a first pair of over-the-shoulder straps each connected at one end thereof to an outside edge of said frame adjacent to the intersection of said frame side and top edges and each connected at another end thereof to the outside surface of said body-encircling belt at a location adjacent to side of the wearer's hips in the wearer's buttock region whereby the first pair of over-the-shoulder straps extend around the wearer's shoulders to support the frame via the wearer's shoulders engaging the wearer laterally outside the chest area in a weight-supporting manner so the wearer's breathing is not unduly impaired by the over-the-shoulder straps; the over-the-shoulder straps and the body-encircling belt being adapted to cooperate with each other to detachably hold the frame against the wearer's back; a porous fabric panel having at least a lower marginal edge thereof attached to the frame along a line spaced down from the top of said frame; a second pair of adjustable straps interconnecting the top of the frame with transversely-spaced points along a top edge of the panel, said panel and second pair of straps cooperating with each other and with said frame to define an open-topped pouch adapted to support an oxygen container in a secure manner which essentially prevents movement of the oxygen container with respect to the wearer's back; and, at least a third pair of adjustable straps interconnecting the sides of the panel to the frame at points thereon alongside a container housed in the pouch, said third pair of straps being effective upon being foreshortened to draw the sides of the pouch against oxygen container so as to prevent movement thereof from side-to side while permitting said container to breathe when thus confined.

2. The backpack type carrier as set forth in claim 1 in which: the bottom of the porous fabric panel is turned under to define an upwardly-extending flap on the inside of the pouch; and, in which means are provided on opposte sides of the flap thus formed for detachably connecting same to opposed portions of the panel thus producing an upwardly-opening pocket closed at the sides for receiving and confining the bottom of the oxygen container.

3. The backpack type carrier as set forth in claim 1 in which: the porous fabric panel is formed of open-weave netting effective to provide an oxygen container confined therein with access to the atmosphere.

4. The backpack type carrier as set forth in claim 1 in which: the second set of adjustable straps converge at their point of attachment to the frame thus defining a generally triangularly-shaped opening at the top of the pouch adapted to receive and confine the neck of an oxygen bottle.

5. The backpack type carrier as set forth in claim 1 in which: a fourth pair of adjustable straps interconnect the sides of the fabric panel to the frame at points alongside an oxygen container housed in the pouch, said fourth pair of straps being spaced above or below the third pair thereof and cooperating therewith to confine the sides of the container while leaving the portions of the pouch therebetween open to the atmosphere in the event said container is vented.

6. The backpack type carrier as set forth in claim 1 in which: an upwardly-opening pocket formed of a porous breathable material is attached to the outside of a pouch in position to receive and store the breathing tube of a portable oxygen dispenser stored in the pouch while, at the same time, providing said dispenser access to the atmosphere.

7. The backpack type carrier as set forth in claim 1 in which: a paded hood sized and adapted to cover a regulator atop the container of an oxygen dispenser housed in the pouch is detachably connectable thereto for cushioning a user's head.

8. The backpack type carrier as set forth in claim 1 in which: an openable fabric flap is located atop the frame at one side thereof for releasably retaining an oxygen delivery tube passing from an oxygen dispenser housed within the pouch over the shoulder and onto the user's body.

9. The backpack type carrier as set forth in claim 1 in which: a handle-forming loop is provided atop the frame centered between the sides of said frame.

10. The backpack type carrier as set forth in claim 1 in which: a pair of crossed rigid struts are located within the frame extending between opposite corners thereof.

11. The backpack type carrier as set forth in claim 7 in which: a transparent window for viewing regulator gages is provided in the portion of the padded hood facing rearwardly.

12. The backpack type carrier as set forth in claim 10 in which: the crossed struts are bent and contoured to approximate the shape of the wearer's back.

* * * * *